US005903979A

United States Patent [19]

Oldroyd

[11] Patent Number: 5,903,979

[45] Date of Patent: May 18, 1999

[54] SAFETY RAZORS

[75] Inventor: Brian Oldroyd, Reading, United Kingdom

[73] Assignee: The Gillette Company, Boston, Mass.

[21] Appl. No.: 08/765,705

[22] PCT Filed: Jul. 11, 1995

[86] PCT No.: PCT/US95/08634

§ 371 Date: Apr. 29, 1997

§ 102(e) Date: Apr. 29, 1997

[87] PCT Pub. No.: WO96/02369

PCT Pub. Date: Feb. 1, 1996

[30] Foreign Application Priority Data

Jul. 13, 1994 [GB] United Kingdom ..... 9414092

[51] Int. Cl.[6] ..... B26B 21/14

[52] U.S. Cl. ..... 30/41; 30/50; 30/77

[58] Field of Search ..... 30/47, 77, 50, 30/41

[56] References Cited

U.S. PATENT DOCUMENTS

| | | | |
|---|---|---|---|
| D. 343,254 | 1/1994 | Miller et al. | D28/47 |
| D. 343,255 | 1/1994 | Miller et al. | D28/47 |
| 1,355,840 | 4/1920 | Kaylor . | |
| 2,120,940 | 6/1938 | Minassian | 30/41 |
| 2,327,192 | 8/1943 | Keene | 30/41 |
| 2,447,358 | 8/1948 | Neuburger | 30/41 |
| 2,707,326 | 5/1955 | Calabretta | 30/41 |
| 2,747,273 | 5/1956 | Olsson | 30/41 |
| 2,790,234 | 4/1957 | Goldstein | 30/41 |
| 3,139,683 | 7/1964 | Waldman | 30/41 |
| 3,176,391 | 4/1965 | Resnick et al. | 30/41 |
| 3,353,264 | 11/1967 | Waldman | 30/41 |
| 3,412,465 | 11/1968 | Andersen | 30/41 |
| 3,648,366 | 3/1972 | Harrison, Sr. | 30/41 |
| 3,768,161 | 10/1973 | Miller | 30/41 |
| 3,969,817 | 7/1976 | DiBuono | 30/41 |
| 4,170,821 | 10/1979 | Booth | 30/41 |
| 4,238,882 | 12/1980 | Harrison, Sr. | 30/41 |
| 4,247,982 | 2/1981 | Booth et al. | 30/41 |
| 4,314,404 | 2/1982 | Ruiz et al. | 30/41 |
| 4,635,361 | 1/1987 | DeMars | 30/41 |
| 4,716,652 | 1/1988 | Cataudella | 30/41 |
| 4,800,649 | 1/1989 | Cataudella | 30/41 |
| 4,809,432 | 3/1989 | Schauble | 30/41 |
| 4,850,107 | 7/1989 | Valliades et al. | 30/41 |
| 4,944,090 | 7/1990 | Sumnall | 30/41 |
| 4,977,669 | 12/1990 | Clifford | 30/41 |
| 5,056,222 | 10/1991 | Miller et al. | 30/77 |
| 5,072,512 | 12/1991 | Noujain | 30/41 |
| 5,092,042 | 3/1992 | Miller et al. | 30/77 |
| 5,121,541 | 6/1992 | Patrakis | 30/41 |
| 5,134,775 | 8/1992 | Althaus et al. | 30/41 |
| 5,141,349 | 8/1992 | Maguire, Jr. et al. | 401/195 |
| 5,168,628 | 12/1992 | Mock et al. | 30/41 |
| 5,191,712 | 3/1993 | Crook et al. | 30/34.2 |

(List continued on next page.)

FOREIGN PATENT DOCUMENTS

| | | |
|---|---|---|
| 0 366 139 A2 | 5/1990 | European Pat. Off. . |
| 0 463 992 A1 | 1/1992 | European Pat. Off. . |
| 974390 | 2/1951 | France . |
| 66602 | 1/1957 | France . |
| 640185 | 7/1950 | United Kingdom . |
| 690828 | 4/1953 | United Kingdom . |
| 2141656 | 1/1985 | United Kingdom . |
| 2246314 | 1/1992 | United Kingdom . |

*Primary Examiner*—Hwei-Siu Payer
*Attorney, Agent, or Firm*—Edward S. Podszus

[57] ABSTRACT

A safety razor blade unit (FIG. 1) comprises at least one elongate blade (1, 2) and a skin-engaging member (3) extending longitudinally of the blade or blades (1, 2) and defining a surface (9) exposed for contact with the skin during shaving. A plurality of pockets (10) is provided in the skin-engaging member (3) for holding respective portions of a shaving enhancement product (FIG. 2). The pockets (10) are distributed along the surface (9) and across the width thereof in an array spanning substantially the whole of the area of the skin-contacting surface (9). The pockets (10) can be in communication with reservoir chamber (4) containing the shave enhancement product.

40 Claims, 2 Drawing Sheets

U.S. PATENT DOCUMENTS

| | | | |
|---|---|---|---|
| 5,283,952 | 2/1994 | Mock et al. | 30/41 |
| 5,369,885 | 12/1994 | Ferraro | 30/41 |
| 5,384,961 | 1/1995 | Gregory | 30/41.5 |
| 5,402,573 | 4/1995 | Laniado | 30/41 |
| 5,402,697 | 4/1995 | Brooks | 83/18 |
| 5,638,601 | 6/1997 | Mol et al. | 30/41 |
| 5,673,485 | 10/1997 | Hill | 30/41.5 |
| 5,689,883 | 11/1997 | Ortiz et al. | 30/34.2 |

SAFETY RAZORS

This invention relates to shaving devices and concerns a safety razor blade unit having at least one blade with a cutting edge which is moved across the surface of the skin being shaved by means of a handle to which the blade unit is attached. The blade unit may be mounted detachably on the handle to enable the blade unit to be replaced by a fresh blade unit when blade sharpness has diminished to an unsatisfactory level, or it may be attached permanently to the handle with the intention that the entire razor be discarded when the blade or blades have become dulled. Razor blade units generally include a guard which defines a surface for contacting the skin in front of the blade(s) and a cap for contacting the skin behind the blade(s), the cap and guard serving important roles in establishing the so-called "shaving geometry", i.e. the parameters which determine the blade orientation and position relative to the skin during shaving. The present invention is especially concerned with the guard and/or cap of a razor blade unit.

As a preliminary step prior to shaving it is common to apply a shaving preparation to the skin, such as shaving soap or the like to facilitate the shaving operation. One effect of the shaving preparation, for example, is to lubricate the skin to enable the razor to slide more easily over the skin. In some situations, however, the skin is not prepared as well as it might be. Furthermore, at the end of shaving most of the preparation will have been removed. Therefore, it can be advantageous to provide the razor with a means for delivering a shaving enhancement composition or medium during shaving. Thus, it is known to provide a blade unit with a strip of material from which a lubricant is very gradually leached out during shaving. The benefits of such a lubricating strip have been well proven, but the active materials which can be incorporated in them is limited, e.g. by the manufacturing process, and the rate at which the lubricant is discharged is so low that an effective preparation of the skin before shaving is still needed. There have also been proposed razors which include a chamber containing a liquid shaving preparation, and a system for discharging the liquid onto the operative parts of the razor by squeezing a sponge impregnated with the liquid by applying finger pressure. However, there still remains a need for a razor adapted to dispense a shaving aid product gradually throughout the useful life of the razor blade unit, without requiring special attention by the user, such as to refill a reservoir or to cause the product to be discharged when required.

According to the present invention there is provided a safety razor blade unit having at least one elongate blade, and a skin engaging member defining a surface exposed for contact with the skin during shaving, said member including a multiplicity of pockets for holding respective portions of shaving enhancement product, said pockets being distributed longitudinally and laterally over the skin contacting surface and each being open at the surface.

A skin engaging member provided according to the invention may allow for the dispensing of materials which can not be included in prior art lubricating strips, e.g. because they can not withstand the manufacturing process. The shaving enhancement product may be a formulation, such as semi-solid gel, which has been designed to have the desired solubilizing properties, and is conveniently retained in the pockets due to the properties of the product. The product may be a viscous fluid, or a gel, and may be of a nature to be miscible with water, which is generally present during shaving, or to dissolve in water, to render the product more fluid for discharge from the pockets.

In order to provide adequate supply of shaving enhancement product to last the useful lifetime of the blade unit, the pockets can communicate at the inner ends with a reservoir chamber containing the shaving enhancement product to be dispensed via the pockets.

The pockets should be disposed in an array with sufficient density of packing to ensure satisfactory application of product during shaving. A width of surface between the adjacent pockets of 5% to 100% of the maximum transverse dimensions of the pockets should be adequate while retaining a sufficiently well defined skin contacting surface.

In a preferred construction the pockets are cylindrical, i.e. have smoothly curved side walls, and conveniently the pockets are right circular cylindrical with their axes substantially perpendicular to the skin contacting surface. However, other shapes are also possible, such as hexagonal or elliptical in cross section. The depth of the pockets is less than the pocket diameter, e.g. approximately equal to the pocket radius, and the thickness of material between adjacent pockets is less than the pocket radius.

The pockets are preferably formed in a front wall of a chamber for holding a supply of a fluid shaving enhancement product, each of the pockets communicating with the chamber through a restricted opening to control flow of product into the pockets and hence release at the skin contacting surface.

The skin engaging member can be the guard of the blade unit or it can be another member, such as the cap.

A better understanding of the invention will be gained from the following detailed description of an embodiment, reference being made to the accompanying drawings, in which.

Figure 1:
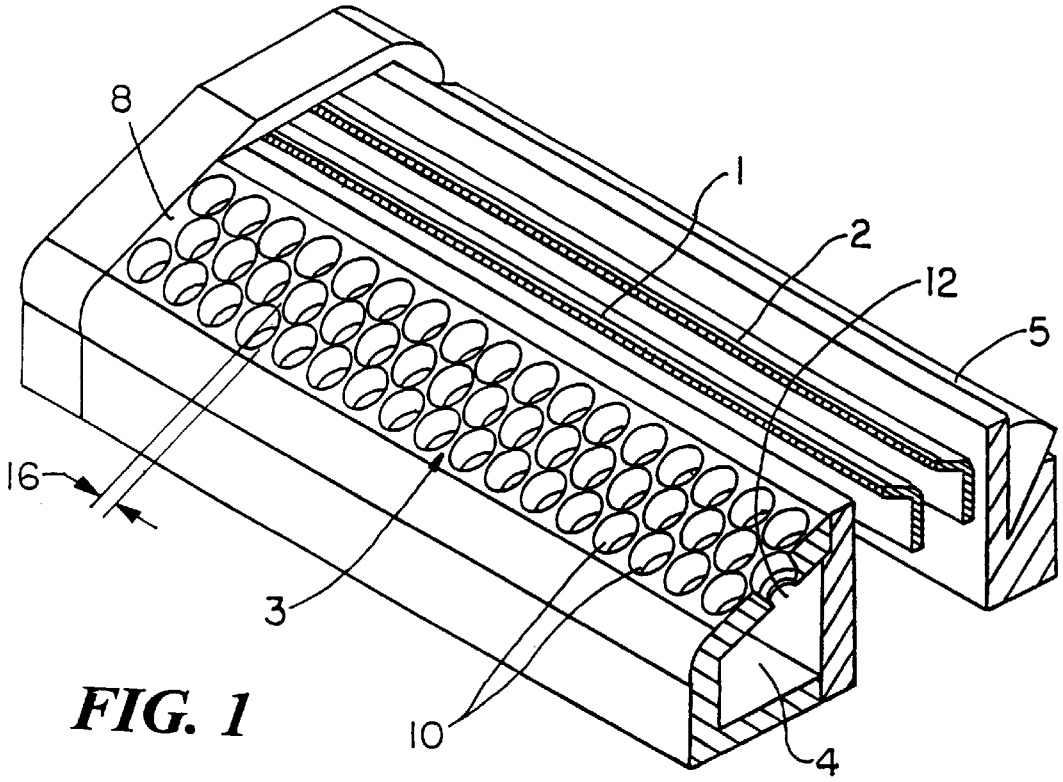
FIG. 1 is a cut away perspective view of a razor blade according to the invention.
Figure 2:
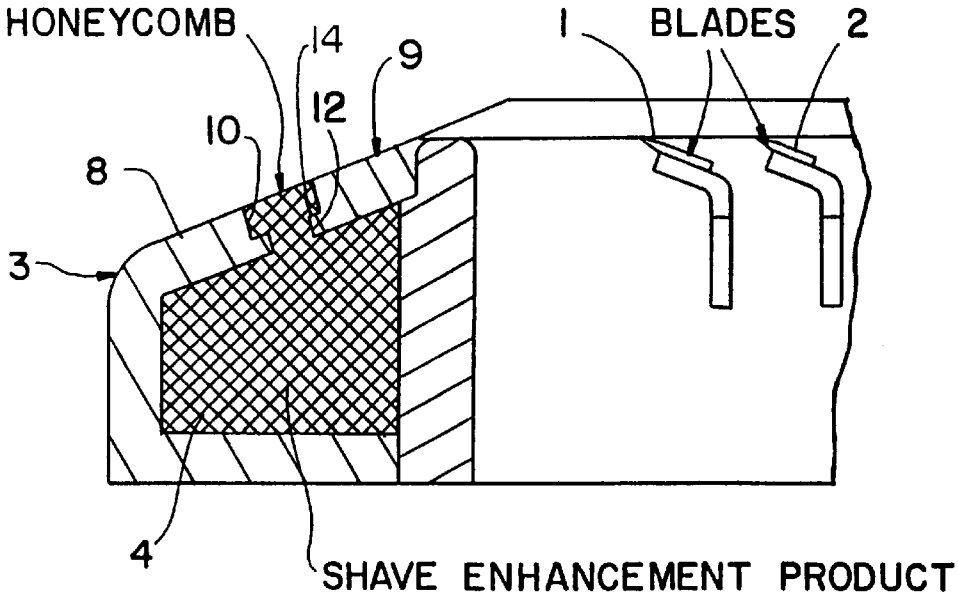
FIG. 2 is a transverse cross section through the blade unit.
Figure 3:
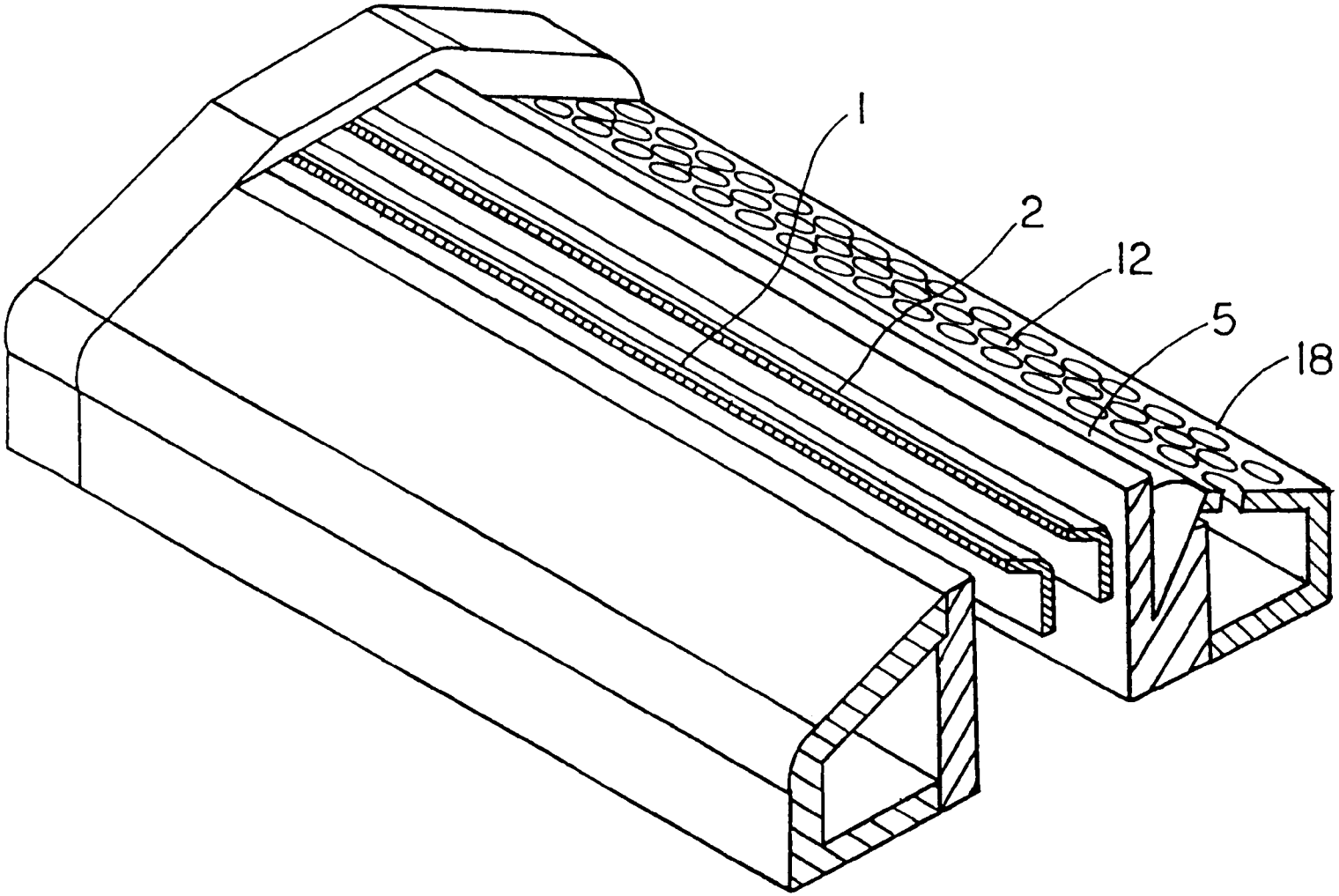
FIG. 3 is a cut away perspective view similar to FIG. 1 of a blade unit according to a further embodiment of the invention.

The safety razor blade unit shown in the drawings comprises a pair of blades 1, 2 mounted in tandem in a supporting frame, a guard 3 fastened to the frame and defining a hollow reservoir chamber 4, and cap 5 e.g. in the form of a strip of lubricating material carried by the frame behind the blades.

The guard includes an upper wall 8 with an exposed surface 9 which is arranged to contact the skin during shaving. Within this wall is formed a multiplicity of pockets 10 positioned in a regular array extending over the length and width of the skin contacting surface. The pockets are disposed in a plurality of longitudinal rows, and in the shown example there are three rows with the pockets in adjacent rows longitudinally off set to permit the pockets to be closely spaced. The pockets are of circular configuration and in the illustrated embodiment all have the same diameter. The pockets as shown in FIG. 1 may overlap, as indicated by spacing 16, viewed from a direction transverse to the longitudinal extent of the rows, by which pockets of one row appear to be partially behind adjacent pockets of the adjacent row. The overlap results from a relative longitudinal offset between adjacent rows of less than a full pocket maximum transverse dimension (e.g. diameter).

Each pocket 10 is in communication with the reservoir chamber 4 through a hole 12 shown to be of restricted area at the inner end 14 (also referred to as floor portion) of the pocket. The through flow area of the hole is selected to allow shaving enhancement product contained in the chamber 4 to flow at a controlled rate into the pockets where the product collects and remains held e.g. under the surface tension properties of the fluid product, ready to be discharged during shaving. The restricted hole also serves to obstruct the passage of the shaving aid product from the pocket back into the reservoir chamber, so that the pockets remain charged with product. In practice the reservoir chamber will contain sufficient volume of shaving aid product to last the full useful lifetime of the blade unit, that is until the blades have become dulled.

The shaving aid product preferably has lubricating property, but it may have, either alternatively or in addition, other, e.g. moisturizing properties considered beneficial during shaving. It will have adequate fluidity to enable the product to pass from the reservoir chamber into the pockets, and adequate viscosity and surface tension characteristics to be held in the pockets without flowing freely out from the pocket openings, and to be dispensed gradually during shaving, e.g. upon being made more fluid by contact with water, when the guard surface slides over the skin during shaving.

It is not an essential feature that the pockets should be supplied with shaving enhancement product and it is within the ambit of the present invention for the pockets to be shaped and dimensioned to collect a shaving enhancement product applied to the skin during one time of shaving and to retain that product until the next time of shaving, e.g. to provide improved lubrication during the initial stages of the subsequent shave.

Modifications are of course possible without departing from the underlying inventive concept. For example, the member incorporating the pockets filled with shaving aid product could be made of a resilient material so that the member will flex slightly during shaving to encourage product to flow from the pockets. In addition to the benefits mentioned above the apertured member with the pockets may have a beneficial tactile influence upon the skin.

I claim:

1. A safety razor blade unit comprising at least one elongate blade, and a skin engaging member extending longitudinally of the blade(s) and having a skin contacting surface exposed for contact with a skin of a user during shaving, said member including a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in a plurality of generally longitudinally extending rows forming an array spanning substantially the whole of the area of the skin contacting surface.

2. A safety razor blade unit according to claim 1, wherein the pockets have smoothly curved side walls.

3. A safety razor blade unit according to claim 2, wherein the pockets are cylindrical with the axes thereof substantially perpendicular to the skin contacting surface.

4. A safety razor blade unit according to claim 3, wherein the pockets are right circular cylindrical.

5. A safety razor blade unit according to claim 4, wherein the pockets have a depth not greater than the pocket diameter.

6. A safety razor blade unit according to claim 1, wherein the pockets have depth at least about 50% of the maximum transverse dimension of the pockets.

7. A safety razor blade unit according to claim 6, wherein the pockets have depth not greater than the maximum transverse dimension of the pockets.

8. A safety razor blade unit according to claim 1, wherein the skin engaging member comprises a resilient material to flex during shaving and exert traction force on the skin surface being shaved.

9. A safety razor blade unit according to claim 1, wherein the distance between adjacent pockets is less than 50% of the maximum transverse dimension of the pockets.

10. A safety razor blade unit according to claim 1, wherein there are at least three longitudinally extending rows of pockets.

11. A safety razor blade unit according to claim 1, wherein the skin engaging member occupies a position of a guard surface in advance of the at least one blade.

12. A safety razor blade unit according to claim 1, wherein the skin engaging member occupies a position of a cap surface behind the at least one blade.

13. A safety razor blade unit according to claim 1, wherein the pockets are further defined by floor portions formed transverse to the depending side wall portions.

14. A safety razor blade unit comprising at least one elongate blade, and a skin engaging member extending longitudinally of the blade(s) and having a skin contacting surface exposed for contact with a skin of a user during shaving, said member including a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in a plurality of generally longitudinally extending rows forming an array spanning substantially the whole area of the skin contacting surface, each pocket containing the non-rigid shaving enhancement product which is retained in the pocket due to the properties of the product and which is discharged gradually therefrom during shaving.

15. A safety razor blade unit according to claim 14, wherein the pockets have depth at least about 50% of the maximum transverse dimension of the pockets.

16. A safety razor blade unit according to claim 15, wherein the pockets have depth not greater than the maximum transverse dimension of the pockets.

17. A safety razor blade unit according to claim 14, wherein the skin engaging member comprises a resilient material to flex during shaving and exert traction force on the skin surface being shaved.

18. A safety razor blade unit according to claim 14, wherein the distance between adjacent pockets is less than 50% of the maximum transverse dimension of the pockets.

19. A safety razor blade unit according to claim 14, wherein there are at least three longitudinally extending rows of pockets.

20. A safety razor blade unit according to claim 14, wherein the skin engaging member occupies a position of a guard surface in advance of the at least one blade.

21. A safety razor blade unit according to claim 14, wherein the skin engaging member occupies a position of a cap surface behind the at least one blade.

22. A safety razor blade unit according to claim 14, wherein the pockets are further defined by floor portions formed transverse to the depending side wall portions.

23. A safety razor blade unit according to claim 13 or 22, further comprising a reservoir chamber containing the non-rigid shaving enhancement product, and wherein the pocket floor portions define flow restricting apertures in communication with the reservoir chamber, said flow restricting apertures metering a flow of the product from the reservoir chamber to the skin contacting surface and constricting a backflow into the reservoir chamber so the pockets remain charged with product.

24. A safety razor blade unit comprising at least one elongate blade, and a skin engaging member extending longitudinally of the blade(s) and having a skin contacting surface exposed for contact with a skin of a user during shaving, said member including a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in an array spanning substantially the whole area of the skin contacting surface, and inner end portions of at least some of the pockets defining flow metering apertures communicating with a reservoir chamber containing the shaving enhancement product to be dispersed via the pockets.

25. A safety razor blade unit according to claim 24, wherein each pocket communicates with the reservoir chamber.

26. A safety razor blade unit according to claim 24, wherein the pockets are formed in a wall member partially confining the reservoir chamber.

27. A safety razor blade unit according to claim 24, wherein the pockets are positioned in a plurality of longitudinal rows.

28. A safety razor blade unit according to claim 27, wherein there are at least three longitudinally extending rows of pockets.

29. A safety razor blade unit according to claim 24, wherein the pockets have depth at least about 50% of the maximum transverse dimension of the pockets.

30. A safety razor blade unit according to claim 29, wherein the pockets have depth not greater than the maximum transverse dimension of the pockets.

31. A safety razor blade unit according to claim 24, wherein the skin engaging member comprises a resilient material to flex during shaving and exert traction force on the skin surface being shaved.

32. A safety razor blade unit according to claim 24, wherein the distance between adjacent pockets is less than 50% of the maximum transverse dimension of the pockets.

33. A safety razor blade unit according to claim 24, wherein the skin engaging member occupies a position of a guard surface in advance of the at least one blade.

34. A safety razor blade unit according to claim 24, wherein the skin engaging member occupies a position of a cap surface behind the at least one blade.

35. A safety razor blade unit according to claim 1, 14 or 24, wherein the at least one elongate blade comprises a linear edged blade member.

36. A safety razor blade unit comprising at least one elongate blade, and a skin engaging member extending longitudinally of the blade(s), said member having a skin contacting surface exposed for contact with a skin of a user during shaving, said member including a multiplicity of pockets for holding respective portions of a shaving enhancement product, each of said pockets opening at the skin contacting surface, said pockets being distributed along the surface and across the width thereof in an array spanning substantially the whole of the area of the skin contacting surface, wherein the pockets are positioned in a plurality of longitudinal rows, and the pockets of adjacent rows are longitudinally offset.

37. A safety razor blade unit according to claim 1 or 36, wherein adjacent pockets of the array of pockets are spaced at a distance of 5% to 100% of the maximum transverse dimension of the pockets.

38. A safety razor blade unit comprising at least one elongate blade, and a skin engaging member extending longitudinally of the blade(s), said member having a skin contacting surface exposed for contact with a skin of a user during shaving, said member including a multiplicity of pockets for holding respective portions of a shaving enhancement product, each of said pockets opening at the skin contacting surface, said pockets being distributed along the surface and across the width thereof in an array spanning substantially the whole area of the skin contacting surface, each pocket containing a shaving enhancement product which is retained in the pocket due to the properties of the product and which is discharged gradually therefrom during shaving, and wherein the pockets are positioned in a plurality of longitudinal rows, wherein the pockets of adjacent rows are longitudinally offset.

39. A safety razor blade unit comprising at least one elongate blade, and a skin engaging member extending longitudinally of the blade(s), said member having a skin contacting surface exposed for contact with a skin of a user during shaving, said member including a multiplicity of pockets for holding respective portions of a shaving enhancement product, each of said pockets opening at the skin contacting surface, said pockets being distributed along the surface and across the width thereof in an array spanning substantially the whole area of the skin contacting surface, and inner end portions of at least some of the pockets communicating with a reservoir chamber containing shaving enhancement product to be dispersed via the pockets, and wherein the pockets are positioned in a plurality of longitudinal rows, wherein the pockets of adjacent rows are longitudinally offset.

40. A safety razor blade unit according to claim 36, 38 or 39, wherein neighboring rows are offset relative one another in the longitudinal direction by an amount less than a maximum transverse dimension of the pockets, whereby an overlap, as viewed projected in a direction transverse to the longitudinal extent of the rows, results between neighboring pockets of adjacent rows.

* * * * *

US005903979C1

(12) EX PARTE REEXAMINATION CERTIFICATE (5428th)

United States Patent
Oldroyd

(10) Number: US 5,903,979 C1
(45) Certificate Issued: Jun. 27, 2006

(54) SAFETY RAZORS

(75) Inventor: Brian Oldroyd, Reading (GB)

(73) Assignee: The Gillette Company, Boston, MA (US)

Reexamination Request:
No. 90/006,510, Jan. 6, 2003

Reexamination Certificate for:
Patent No.: 5,903,979
Issued: May 18, 1999
Appl. No.: 08/765,705
Filed: Apr. 29, 1997

(22) PCT Filed: Jul. 11, 1995

(86) PCT No.: PCT/US95/08634

§ 371 (c)(1),
(2), (4) Date: Apr. 29, 1997

(87) PCT Pub. No.: WO96/02369

PCT Pub. Date: Feb. 1, 1996

(30) Foreign Application Priority Data

Jul. 13, 1994 (GB) ..... 9414092

(51) Int. Cl.
*B26B 21/14* (2006.01)

(52) U.S. Cl. ..... 30/41; 30/50; 30/77
(58) Field of Classification Search ..... 30/41.6, 30/43.92, 537, 538, 50
See application file for complete search history.

(56) References Cited

U.S. PATENT DOCUMENTS 330,418 A * 11/1885 Partridge et al. ..... 30/77
1,416,199 A 5/1922 Hasselquist
1,768,397 A 6/1930 Bleloch et al.
2,120,940 A * 6/1938 Minassian ..... 30/41
2,183,554 A 12/1939 Evans ..... 30/84
2,336,806 A * 12/1943 Schenk et al. ..... 30/538
2,510,612 A * 6/1950 Wahnish ..... 30/41.6
2,593,306 A * 4/1952 Jacobsen ..... 30/70
3,477,127 A 11/1969 Regan ..... 30/41
3,958,692 A * 5/1976 Pomfret ..... 30/50
4,063,354 A * 12/1977 Oldroyd et al. ..... 30/50
D292,623 S 11/1987 Iten ..... D28/47
4,741,103 A 5/1988 Hultman ..... 30/34.2
4,998,347 A 3/1991 Schächter ..... 30/34.2
5,018,274 A 5/1991 Trotta ..... 30/50
D363,141 S 10/1995 Burout et al. ..... D28/46
5,456,009 A 10/1995 Wexler ..... 30/77
5,524,347 A 6/1996 Prochaska ..... 30/50
5,590,468 A 1/1997 Prochaska ..... 30/41

FOREIGN PATENT DOCUMENTS

GB 1157640 7/1969 ..... 21/44

* cited by examiner

*Primary Examiner*—Stephen Choi

(57) ABSTRACT

A safety razor blade unit (FIG. 1) comprises at least one elongate blade (1, 2) and a skin-engaging member (3) extending longitudinally of the blade or blades (1, 2) and defining a surface (9) exposed for contact with the skin during shaving. A plurality of pockets (10) is provided in the skin-engaging member (3) for holding respective portions of a shaving enhancement product (FIG. 2). The pockets (10) are distributed along the surface (9) and across the width thereof in an array spanning substantially the whole of the area of the skin-contacting surface (9). The pockets (10) can be in communication with reservoir chamber (4) containing the shave enhancement product.

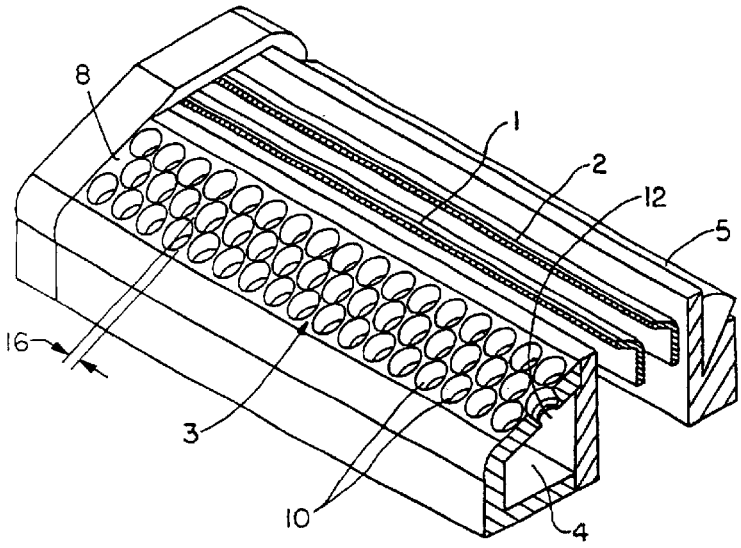

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 8 and 17 are cancelled.

Claims 1, 3, 14, 23, 24, 36 and 38–40 are determined to be patentable as amended.

Claims 4–7, 9–13, 15, 16, 18–22, 25–35 and 37, dependent on an amended claim, are determined to be patentable.

New claims 41–48 are added and determined to be patentable.

1. A safety razor blade unit comprising at least one elongate blade, and a skin engaging member extending longitudinally of the blade(s) and having a skin contacting surface exposed for contact with a skin of a user during shaving, said member [including] *comprising*

*a resilient material to flex during shaving and exert traction force on the skin surface being shaved; and* a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in a plurality of generally longitudinally extending rows forming an array spanning substantially the whole of the area of the skin contacting surface.

3. A safety razor blade unit according to claim [2] *48*, wherein the pockets are cylindrical with the axes thereof substantially perpendicular to the skin contacting surface.

14. A safety razor blade unit comprising at least one elongate blade, and a skin engaging member extending longitudinally of the blade(s) and having a skin contacting surface exposed for contact with a skin of a user during shaving, said member [including] *comprising*

*a resilient material to flex during shaving and exert traction force on the skin surface being shaved; and* a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in a plurality of generally longitudinally extending rows forming an array spanning substantially the whole area of the skin contacting surface, each pocket containing the non-rigid shaving enhancement product which is retained in the pocket due to the properties of the product and which is discharged gradually therefrom during shaving.

23. [A safety razor blade unit according to claim 13 or 22.] *A safety razor blade unit comprising*

*at least one elongate blade, and*

*a skin engaging member extending longitudinally of the blade(s) and having a skin contacting surface exposed for contact with a skin of a user during shaving, said member including*

*a multiplicity of pockets for holding respective portions of a non-rigid shaving enhancement product, each of said pockets opening at the skin contacting surface and being defined by side wall portions depending inward from the skin contacting surface,*

*said pockets being distributed along the surface and across the width thereof in a plurality of generally longitudinally extending rows forming an array spanning substantially the whole of the area of the skin contacting surface,*

*wherein the pockets are further defined by floor portions formed transverse to the depending side wall portions*, further comprising a reservoir chamber containing the non-rigid shaving enhancement product, and wherein the pocket floor portions define flow restricting apertures in communication with the reservoir chamber, said flow restricting apertures metering a flow of the product from the reservoir chamber to the skin contacting surface and constricting a backflow into the reservoir chamber so the pockets remain charged with product.

24. A safety razor blade unit comprising at least one elongate blade, and a skin engaging member extending longitudinally of the blade(s) and having a skin contacting surface exposed for contact with a skin of a user during shaving, said member including a multiplicity of pockets for holding respective portions of a non-rigid shaving enhancement product, each of said pockets opening at the skin contacting surface and being defined by side wall portions depending inward from the skin contacting surface *and an inner floor portion*, said pockets being distributed along the surface and across the width thereof in an array spanning substantially the whole area of the skin contacting surface, and *said* inner [end] *floor* portions of at least some of the pockets defining flow metering apertures communicating with a reservoir chamber containing the shaving enhancement product to be dispersed via the pockets.

36. A safety razor blade unit comprising at least one elongate blade, and a skin engaging member extending longitudinally of the blade(s), said member having a skin contacting surface exposed for contact with a skin of a user during shaving, said member [including] *comprising*

*a resilient material to flex during shaving and exert traction force on the skin surface being shaved; and* a multiplicity of pockets for holding respective portions of a shaving enhancement product, each of said pockets opening at the skin contacting surface, said pockets being distributed along the surface and across the width thereof in an array spanning substantially the whole of the area of the skin contacting surface, wherein the pockets are positioned in a plurality of longitudinal rows, and the pockets of adjacent rows are longitudinally offset.

38. A safety razor blade unit comprising at least one elongate blade, and a skin engaging member extending longitudinally of the blade(s), said member having a skin contacting surface exposed for contact with a skin of a user during shaving, said member [including] *comprising*

*a resilient material to flex during shaving and exert traction force on the skin surface being shaved; and* a multiplicity of pockets for holding respective portions of a shaving enhancement product, each of said pockets opening at the skin contacting surface, said pockets being distributed along the surface and across the width thereof in an array spanning substantially the whole area of the skin contacting surface, each pocket containing a shaving enhancement product which is retained in the pocket due to the properties of the product and which is discharged gradually therefrom during shaving, and wherein the pockets are positioned in a plurality of longitudinal rows, wherein the pockets of adjacent rows are longitudinally offset.

39. A safety razor blade unit comprising at least one elongate blade, and a skin engaging member extending longitudinally of the blade(s), said member having a skin contacting surface exposed for contact with a skin of a user during shaving, said member including a multiplicity of pockets for holding respective portions of a shaving enhancement product, each of said pockets opening at the skin contacting surface *and comprising an inner floor portion*, said pockets being distributed along the surface and across the width thereof in an array spanning substantially the whole area of the skin contacting surface, and *said* inner [end] *floor* portions of at least some of the pockets *defining flow metering apertures* commmunicating with a reservoir chamber containing shaving enhancement product to be dispersed via the pockets; and wherein the pockets are positioned in a plurality of longitudinal rows, wherein the pockets of adjacent rows are longitudinally offset.

40. A safety razor blade unit according to claim [36, 38 or] 39, wherein neighboring rows are offset relative one another in the longitudinal direction by an amount less than a maximum transverse dimension of the pockets, whereby an overlap, as viewed projected in a direction transverse to the longitudinal extent of the rows, results between neighboring pockets of adjacent rows.

*41. A safety razor blade unit comprising at least one elongate blade, and a skin engaging member extending longitudinally of the blade(s) and having a skin contacting surface exposed for contact with a skin of a user during shaving, said member including a multiplicity of pockets for holding respective portions of a non-rigid shaving enhancement product, each of said pockets opening at the skin contacting surface and being defined by side wall portions depending inward from the skin contacting surface, said pockets being distributed along the surface and across the width thereof in a plurality of generally longitudinally extending rows forming an array spanning substantially the whole area of the skin contacting surface, each pocket containing the non-rigid shaving enhancement product which is retained in the pocket due to the properties of the product and which is discharged gradually therefrom during shaving, wherein the pockets are further defined by floor portions formed transverse to the depending side wall portions, further comprising*

*a reservoir chamber containing the non-rigid shaving enhancement product, and*

*wherein the pocket floor portions define flow restricting apertures in communication with the reservoir chamber, said flow restricting apertures metering a flow of the product from the reservoir chamber to the skin contacting surface and constricting a backflow into the reservoir chamber so the pockets remain charged with product.*

*42. A safety razor blade unit according to claim 36, wherein the skin engaging member occupies a position of a guard surface in advance of the at least one blade.*

*43. A safety razor blade unit according to claim 38, wherein the skin engaging member occupies a position of a guard surface in advance of the at least one blade.*

*44. A safety razor blade unit according to claim 1, 11, 14, 20, 36, 38, 39, 42 or 43, wherein said shaving enhancement product includes a member selected from the group consisting of shaving soap, a formulation, semi-solid gel, a viscous fluid, a gel, a water-soluble product, and a water miscible product.*

*45. A safety razor blade unit according to claim 11, 20, 42, or 43, wherein said guard surface extends continuously as an integral unit parallel to said at least one blade.*

*46. A safety razor blade unit according to claim 36 or 38, wherein said pockets of adjacent rows partially overlap when viewed in a direction transverse to the longitudinal extent of said rows.*

*47. A safety razor blade unit according to claim 42 or 43, wherein said pockets of adjacent rows partially overlap when viewed in a direction transverse to the longitudinal extent of said rows, and*

*wherein said guard extends continuously as an integral unit parallel to said blade(s), and*

*wherein said non-rigid shaving enhancement product includes a member selected from the group consisting of shaving soap, a formulation, semi-solid gel, a viscous fluid, a gel, a water-soluble product and a water miscible product.*

*48. A safety razor blade unit according to claim 1, wherein the pockets have smoothly curved side walls.*

* * * * *